US006299007B1

(12) United States Patent
Takeuchi

(10) Patent No.: US 6,299,007 B1
(45) Date of Patent: Oct. 9, 2001

(54) HEAT-RESISTANT PACKAGING CONTAINER MADE OF POLYESTER RESIN

(75) Inventor: Setsuyuki Takeuchi, Nagano-ken (JP)

(73) Assignee: A. K. Technical Laboratory, Inc., Nagano-Ken (JP)

( * ) Notice: Subject to any disclaimer, the term of this patent is extended or adjusted under 35 U.S.C. 154(b) by 0 days.

(21) Appl. No.: 09/420,680

(22) Filed: Oct. 19, 1999

(30) Foreign Application Priority Data

Oct. 20, 1998 (JP) ..... 10-298536

(51) Int. Cl.[7] ..... B65D 1/02; B65D 1/10; B65D 23/00

(52) U.S. Cl. ..... 215/373; 215/371; 220/606

(58) Field of Search ..... 215/373, 371; 220/606, 609

(56) References Cited

U.S. PATENT DOCUMENTS

| | | | | |
|---|---|---|---|---|
| 4,247,012 | * | 1/1981 | Alberghini | 220/606 X |
| 4,381,061 | * | 4/1983 | Cerny et al. | 220/609 |
| 4,412,627 | * | 11/1983 | Houghton et al. | 220/609 |
| 4,465,199 | * | 8/1984 | Aoki | 215/373 |
| 4,894,268 | * | 1/1990 | Greenwood et al. | 215/373 X |
| 4,959,006 | | 9/1990 | Feddersen et al. | 425/533 |
| 4,991,734 | * | 2/1991 | Nilsson et al. | 215/373 X |
| 5,234,126 | * | 8/1993 | Jonas et al. | 215/373 X |
| 5,269,437 | * | 12/1993 | Gygax | 215/373 X |

FOREIGN PATENT DOCUMENTS

| | | |
|---|---|---|
| 11-152123 A | 6/1999 | (JP) . |
| 11-165723 A | 6/1999 | (JP) . |
| WO 96/24525 | 8/1996 | (WO) . |

* cited by examiner

*Primary Examiner*—Sue A. Weaver
(74) *Attorney, Agent, or Firm*—Weingarten, Schurgin, Gagnebin & Hayes, LLP

(57) ABSTRACT

A heat-resistant packaging container made of a polyester resin, formed by stretch-blow molding is provided. A top portion of a bottom face is formed to have a large wall thickness to impart a resistance to heat deformation. A peripheral wall of the bottom face is formed to have a wall thickness that is gradually reduced from the top portion toward an arc grounding edge around the bottom face. An outer peripheral wall of the bottom portion is stretch molded from inside of the grounding edge so as to have a wall thickness as same as that of the body portion to attain a heat resistance. The inside of the grounding edge connecting to the peripheral wall of the bottom face is formed into a tilt surface which is oriented upwardly in consideration of an amount of expanding deformation α of the grounding edge due to heating and loading. By forming the bottom face in consideration of a deformation amount of the grounding edge of the bottom face of the container due to heating and loading of contents, it is possible to keep the levelness of the grounding edge even after the heating.

10 Claims, 1 Drawing Sheet

HEAT-RESISTANT PACKAGING CONTAINER MADE OF POLYESTER RESIN

BACKGROUND OF THE INVENTION

1. Field of the Invention

The present invention relates to a heat-resistant packaging container made of a polyester resin, and particularly to a heat-resistant packaging container which is formed by stretch-blow molding a preform of a polyester resin, having a thin-walled body portion and a bottom face recessed into the container.

2. Background Art

In general, packaging containers such as bottles or wide mouthed jars made of a resin, in which a grounding edge around a bottom face is formed together with a body portion so as to have a small wall thickness by stretch-blow molding, exhibit increased durability, transparency, gas-barrier properties, heat resistance and the like because molecules therein are biaxially oriented resulting from vertical stretching by mechanical force, and lateral stretching by air blowing. However, as long as the heat resistance is concerned, since the material is a resin, there is a limitation to the heat-resistant temperature and heat deformation will occur over a certain temperature.

This heat deformation depends on the region of the container, and is likely to occur at a neck portion or a bottom portion in particular. As to the neck portion, it is possible to improve the heat resistance by post treatment such as crystallization. As to the bottom portion, a bottom structure in which a bottom face is formed to be recessed into the container is being employed to improve the resistance to heat deformation.

A temperature of heat deformation of the resin used as the material is about 75° C. in the case of polyethylene terephthalate (PET), for example. Accordingly, at temperatures higher than that temperature, heat deformation occurs at the bottom portion and the levelness of the grounding edge around the bottom face is impaired to render the container unstable, so that the container, if it is of a small size, is liable to fall down, for example, due to vibrations.

In view of the above, as the materials of containers that are required to endure temperatures exceeding 75° C., heat-resistant resins such as polycarbonate (PC) and polypropylene (PP) are adopted. However, PP is inferior to PET in terms of transparency and rigidity of a product, while PC has a problem that the use thereof is restricted because of the problem of oozing out environmental hormones, so that it is difficult to adopt these resins as the materials of containers for packaging foodstuffs or beverages.

In view of the above, polyethylene naphthalate (PEN), a polyester resin similar to PET, whose temperature of heat deformation is about 120° C. is being adopted. However, even in the case of PEN, it is impossible to avoid the heat deformation in the bottom portion. The conventional bottom structure, when heated at a temperature of 100° C. or higher for a long time, causes an irregular deformation on the grounding edge around the bottom face and the grounding edge is expanded out due to a load of contents so that the levelness thereof is impaired and the container is likely to become unstable.

The expanding deformation of the bottom face is attributed to difficulty of molding the grounding edge around the bottom face. The grounding edge around the bottom face is under the condition that the wall thickness thereof is irregularly distributed even though the degree of the irregularity is very small, so that the portions having small wall thicknesses become weak points of the grounding edge. At these thin-walled portions, expanding deformation due to the load under heating is more likely to occur than other portions, to generate unevenness on the grounding edge thereof. This is the reason why the stability of container is impaired after heating. In order to suppress the expanding deformation, many bottom structures have been developed up to now, however, it is almost impossible to eliminate the expanding deformation thoroughly by means of structural measures, and hence the stability after heating must be maintained while allowing a certain compromise.

SUMMARY OF THE INVENTION

The present invention has been made to solve the above-mentioned problems associated with packaging containers that require a heat resistance depending on the contents thereof, and an object of the present invention is to provide a heat-resistant packaging container made of a polyester resin having a novel configuration in which a bottom face is formed in consideration of a deformation of a grounding edge due to heating and loading, thereby maintaining the levelness of the grounding edge and keeping the stability even if the grounding edge is expanded out due to heat deformation and a load of the contents.

Another object of the present invention is to provide a heat-resistant packaging container made of a polyester resin which is suitable for a small container for use as a packaging container of paste foods such as for example baby foods that require heat sterilization after charging.

To attain the above-mentioned object, the present invention provides a heat-resistant packaging container, which is made of a polyester resin such as polyethylene terephthalate (PET), polyethylene naphthalate (PEN) and the like as a material, and formed in such a manner that a body portion biaxially orientated by stretch-blow molding of the material is of a small wall thickness, a peripheral wall of a bottom portion is formed to be inwardly curved and a bottom face is formed to be recessed into the container to have a trapezoidal cross section, wherein a top portion of the bottom face is formed to have a large wall thickness to attain a resistance to heat deformation; the peripheral wall of the bottom face is formed so that a wall thickness thereof gradually becomes smaller from the top portion to an arc grounding edge; an outer peripheral wall of the bottom portion is formed by stretch molding from inside of the grounding edge, so as to have a small wall thickness as same as the body portion to attain a heat resistance; and the inside of the grounding edge connecting to the peripheral wall of the bottom face is formed into a tilt surface diagonally oriented upwardly at a desired angle in consideration of an amount of expanding deformation of the grounding edge due to heating and loading.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

Figure 1:
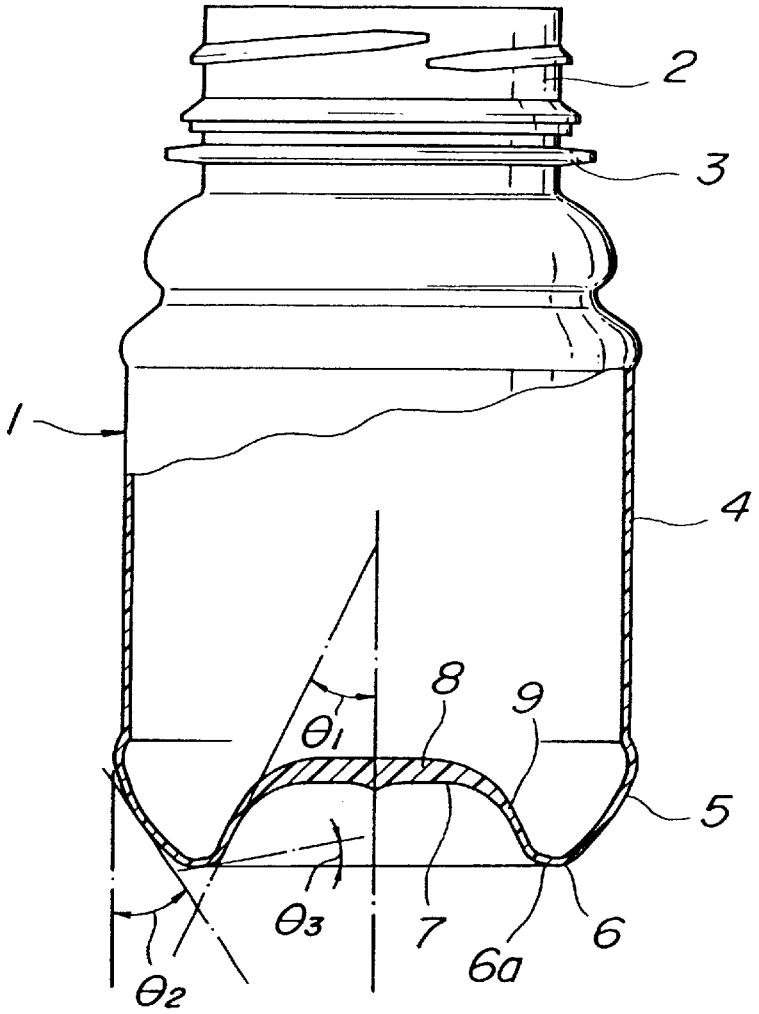
FIG. 1 is a longitudinal elevational view showing essential part of a heat-resistant packaging container made of a polyester resin according to the present invention.

In the drawings, reference numeral 1 denotes a container, for example, for baby foods which is molded by stretch-blow molding a preform prepared by injection molding of PET, PEN or a blended resin thereof, so as to have a small wall thickness. While a neck portion 2 of the container 1 is kept unprocessed after injection molded, the part spanning from underside of a support ring 3 below the neck portion to a bottom face is stretched in both longitudinal and radial directions, so that the part spanning from a body portion 4, through an outer peripheral wall 5 of the bottom portion connecting thereto, to inside of a grounding edge 6 around the bottom face is formed to have a small wall thickness substantially as same as that of the body portion 4.

The outer peripheral wall 5 of the bottom portion has a diameter slightly larger than that of the body portion 4, and is inwardly curved at an angle θ2 of about 30° with respect to the upright body wall. A bottom face 7 is recessed into the container 1 to have a trapezoidal cross section, and a top portion 8 thereof is formed to have a wall thickness significantly larger than that of the grounding edge 6 so as not to cause a heat deformation. A peripheral wall 9 of the bottom face between the top portion 8 and the grounding edge 6 is formed from around the top portion to the grounding edge 6 with being inwardly curved, so that the wall thickness thereof gradually becomes smaller toward the grounding edge 6 and that the peripheral wall 9 connects to the inside of the grounding edge 6 at an angle θ1 of about 20° with respect to the center line of the container 1.

If the angle θ2 of the outer peripheral wall 5 of the bottom portion is larger than 30°, the diameter of the grounding edge 6 becomes small so that the container is liable to be unstable, whereas if the angle θ2 is smaller than 30°, the angle θ1 of the peripheral wall 9 of the bottom face becomes larger than 20° so that the container is liable to collapse by loading. It is preferable that the curve of the outer peripheral wall 5 of the bottom portion has a curvature as same as a radius of curvature in the circumferential direction of the body portion 4.

Figure 2:
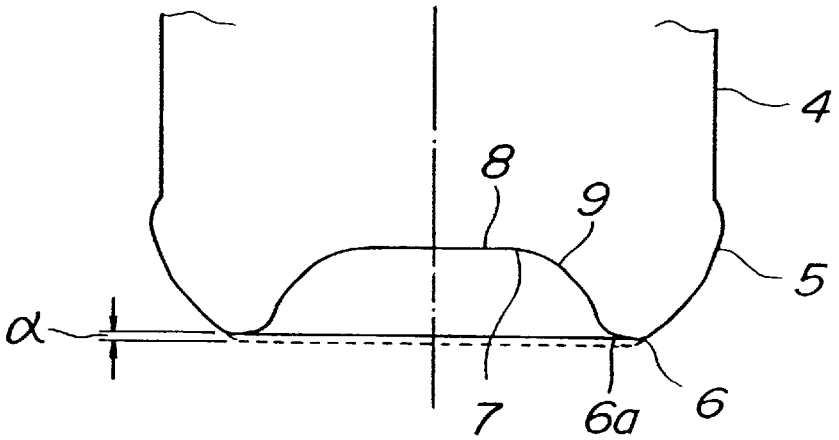
FIG. 2 is an illustrative view showing a state in which the grounding edge is expanded out.

The inside of the grounding edge 6 connecting to the peripheral wall 9 of the bottom face is diagonally oriented upwardly at an angle θ3 of about 10° from an outside arc surface in consideration of an amount of expanding deformation α (see FIG. 2 for reference) due to heating and loading to the grounding edge 6. As a consequence, the grounding edge 6 is formed of the outside arc surface connecting to the outer peripheral wall 5 of the bottom portion and an inside tilt surface 6*a* connecting to the peripheral wall 9 of the bottom face, and in a normal state, a boundary between the arc surface and the tilt surface normally forms a ring-like grounding surface to keep the stability.

In such a bottom structure, when heat (about 76° C. in the case of PET, 110° C. or more in the case of PEN) and a load of contents are applied to the bottom face, stress is concentrated on the grounding edge 6 which is softened by the heating, to push the outer peripheral wall 5 of the bottom portion outwardly so that the bottom face 7 is deformed in such a manner that it is pressed and collapsed. However, the deformation is slightly suppressed because of the opposition by the outer peripheral wall 5 of the bottom portion which is inwardly curved. Furthermore, the stress concentrated on the grounding edge 6 deforms the tilt surface 6*a* such that the tilt surface 6*a* is outwardly bent from the boundary between the tilt surface and the arc surface, with the result that the stress applied on the grounding edge 6 is released. Therefore, even if the grounding edge 6 includes variations in strength due to differences in wall thickness, irregular expanding deformation will not be caused by a local stress concentration, and the entire grounding edge 6 is expanded out uniformly. As a result of this, after heating for a long period of time, the container still keeps its stability of before heating, even though the bottom portion is deformed to some extent.

EXAMPLE

Molding material: polyethylene naphthalate (PEN)

Container: Container for baby foods

Dimension:

Height: 94.0 mm

Diameter: 56.4 mm

Outside diameter of bottom face (distance between boundaries): 40.9 mm

Inside diameter of bottom face (distance between boundaries of tilt surface and outer peripheral wall of bottom face): 33 mm Height of bottom face: 9.0 mm Radius of curvature (R) of outside arc surface of grounding edge: 2 mm Radius of curvature (R) of peripheral wall of bottom face: 9 mm Expected amount of expanding deformation: 0.7 mm Wall thickness from body portion to grounding edge: about 0.175 mm Wall thickness of top portion of bottom face: about 2.1 mm Angle (θ1): 20°

Angle (θ2): 30°

Angle (θ3): 10°

Heating temperature (steam): 115° C.

Heating time: 35 min. under the condition that baby foods is charged

Result: The amount of expanding deformation fell within the setting and the state of grounding was satisfactory to reveal that the stability was maintained.

While the presently preferred embodiment of the present invention has been shown and described, it will be understood that the present invention is not limited thereto, and that various changes and modifications may be made by those skilled in the art without departing from the scope of the invention as set forth in the appended claims.

What is claimed is:

1. A heat-resistant packaging container, in which a body portion is formed to have biaxial orientation by stretch-blow molding of a polyester resin, an outer peripheral wall of a bottom portion is formed to be inwardly curved, and a bottom face is formed to be recessed into the container to have a trapezoidal cross-section, wherein: a top portion of the bottom face is formed to have a large wall thickness to attain a resistance to heat deformation; an inner peripheral wall of the bottom face is formed so that a wall thickness thereof gradually becomes smaller from the top portion to an arc grounding edge; the outer peripheral wall is formed by stretch molding from inside of the grounding edge, so as to have a small wall thickness that is the same as that of the body portion, to attain a heat resistance; and the inside of the grounding edge connecting to the peripheral wall of the bottom face is formed into a tilt surface diagonally oriented upwardly from an outside arc surface at a desired angle in consideration of an amount of expanding deformation of the grounding edge due to heating and loading.

2. The heat-resistant packaging container according to claim 1, wherein the polyester resin is a resin selected from the group consisting of polyethylene terephthalate, polyethylene naphthalate and a mixture thereof.

3. The heat-resistant packaging container according to claim 2, wherein the outer peripheral wall of the bottom portion is formed to have a diameter which is slightly larger than that of the body portion and to be curved inwardly at an angle of about 30° with respect to the upright body portion.

4. The heat-resistant packaging container according to claim 2, wherein the inside of the grounding edge connecting to the inner peripheral wall of the bottom face is formed to be diagonally oriented upwardly from an outside arc surface at an angle of about 10°.

5. The heat-resistant packaging container according to claim 1, wherein the outer peripheral wall of the bottom portion is formed to have a diameter which is slightly large than that of the body portion and to be curved inwardly at an angle of about 30° with respect to the upright body portion.

6. The heat-resistant packaging container according to claim 1, wherein the inside of the grounding edge connecting to the inner peripheral wall of the bottom face is formed to be diagonally oriented upwardly from an outside arc surface at an angle of about 10°.

7. The heat-resistant packaging container of claim 1, being container for baby food.

8. The heat-resistant packaging container of claim 1, wherein a curve of the outer peripheral wall of the bottom portion has a same radius of curvature as the body portion, in a circumferential direction.

9. A heat-resistant packaging container, in which a body portion is formed to have biaxial orientation by stretch-blow molding of a polyester resin, an outer peripheral wall of a bottom portion is formed to have a diameter which is slightly large than that of the body portion and to be curved inwardly at an angle of about 30° with respect to the upright body portion, and a bottom face is formed to be recessed into the container to have a trapezoidal cross-section, wherein:

a top portion of the bottom face is formed to have a large wall thickness to attain a resistance to heat deformation;

an inner peripheral wall of the bottom face is formed so that a wall thickness thereof gradually becomes smaller from the top portion to an arc grounding edge;

the outer peripheral wall is formed by stretch molding from inside of the grounding edge, so as to have a small wall thickness that is the same as that of the body portion, to attain a heat resistance; and the inside of the grounding edge connecting to the peripheral wall of the bottom face is formed into a tilt surface diagonally oriented upwardly from an outside arc surface at an angle of about 10°, in consideration of an amount of expanding deformation of the grounding edge due to heating and loading.

10. The heat-resistant packaging container of claim 9, being a container for baby food.

* * * * *